United States Patent [19]

Dietzel et al.

[11] 4,071,961

[45] Feb. 7, 1978

[54] DRYING DRUM FOR FLUID MATERIALS

[75] Inventors: Walter Dietzel; Siegfried Matusch, both of Braunschweig, Germany

[73] Assignee: Braunschweigische Maschinenbauanstalt, Braunschweig, Germany

[21] Appl. No.: 273,854

[22] Filed: July 21, 1972 (Under 37 CFR 1.47)

[30] Foreign Application Priority Data

July 23, 1971 Germany ..... 2136831

[51] Int. Cl.[2] ..... F27B 7/26; F26B 11/02

[52] U.S. Cl. ..... 34/108; 34/130; 34/121; 432/103; 74/414; 74/582; 188/1 B; 64/2 R; 366/220

[58] Field of Search ..... 432/103–106; 34/130, 108, 121; 248/130, 15, 21; 259/3, 81 R; 51/164; 308/202–205; 74/414, 582; 188/1 B; 64/2 R

[56] References Cited

U.S. PATENT DOCUMENTS

| | | | |
|---|---|---|---|
| 746,683 | 12/1903 | Davidson | 74/414 |
| 937,914 | 10/1909 | Barth | 432/103 |
| 1,822,026 | 9/1931 | Guy | 188/1 B |
| 2,020,764 | 11/1935 | Bradford | 188/1 B |
| 2,793,018 | 5/1957 | Trombe | 432/103 |
| 2,912,233 | 11/1959 | Gergely | 74/582 |
| 3,027,553 | 3/1962 | Sandor | 308/203 |
| 3,236,334 | 2/1966 | Wallerstein, Jr. | 188/1 B |
| 3,399,584 | 9/1968 | Lewicki | 64/2 R |
| 3,405,537 | 10/1968 | Thearle | 64/2 |
| 3,509,742 | 5/1970 | Bauer | 248/21 |
| 3,626,719 | 12/1971 | Church | 64/6 |

FOREIGN PATENT DOCUMENTS

| | | | |
|---|---|---|---|
| 881,927 | 5/1953 | Germany | 432/118 |
| 1,245,819 | 9/1971 | United Kingdom | 259/3 |

*Primary Examiner*—John J. Camby
*Assistant Examiner*—Henry C. Yuen
*Attorney, Agent, or Firm*—W. G. Fasse; W. W. Roberts

[57] ABSTRACT

The present drying drum includes a roller supported drum jacket which is connected at one end thereof to a drive shaft by means of radially extending arms whereby the drive shaft extends coaxially with the rotational axis of the drum jacket. The drive means proper are guided relative to said drive shaft by guide means forming part of the drive shaft itself or either by a bearing surface forming part of a spur gear connected to the drive shaft. The drive means are further connected through a guide rod with an abutment means for taking up the drive reaction.

9 Claims, 3 Drawing Figures

DRYING DRUM FOR FLUID MATERIALS

BACKGROUND OF THE INVENTION

The present invention relates to a drying drum for fluid materials such as sugar or leached sugar beet cossettes. The drying drum comprises a horizontally arranged drum jacket which is supported along its length at least at two positions by means of bearing rollers. The drum jacket is driven by drive means which rotate the drum jacket about a rotational axis.

Heretofore, the construction of the driving device for prior art drying drums has caused considerable difficulties. It is conventional to surround the drum jacket with a ring gear and to drive such ring gear by means of a rigidly supported drive pinion. However, this arrangement has several disadvantages because due to the large dimensions of the drum, it is not possible to effectively support the drum in such a manner that a satisfactory circular rotation is accomplished at least of that drum jacket portion to which said ring gear is attached. However, such satisfactory circular rotation is essential for an efficient meshing between the ring gear and the drive pinion.

Furthermore, due to the large dimensions of the ring gear, correspondingly large dimensional deviations occur because the manufacturing tolerances cannot be limited beyond a range which would increase the manufacturing costs in an unreasonable manner.

Still other difficulties are caused by the fact that the drying drum, during its operation, is subject to the weight of the materials being dried and that the drum is simultaneously exposed to high temperatures because a hot gas stream is conducted through the material in the drum. These gases may enter the interior of the drum at a temperature which depends upon the particular drying job and which may reach up to about 1,000° C. Consequently, substantial heat expansions as well as uncontrollable warpings of the drum jacket cannot be avoided. Thus, it happens that the ring gear moves radially as well as axially relative to the rigidly supported drive pinion during the rotation of the drum jacket. As a result, it is not possible to realize an optimum meshing between the ring gear and the drive pinion.

A faulty intermeshing usually results in overloading of the flanks of the gear teeth which in turn causes a heavy wear and tear of the intermeshing teeth which is unavoidable. Even supporting the drive pinions in a yielding manner does not result in any appreciable improvement of the intermeshing between the gear teeth although such yielding support of the drive pinion increases the costs.

It is further known to provide the drum jacket of a drying drum at one end thereof with a shaft which extends coaxially relative to the rotational axis of the drum. However, in this known construction, the shaft constitutes a supporting element because the shaft replaces the second set of bearing rollers which are generally employed in connection with this type of drying drums. It has further been suggested to drive the drying drum through this shaft which constitutes a bearing means for the drum. However, this is not satisfactory because it is unavoidable that the end of the shaft performs a wobbling motion. Therefore, this known construction requires expensive, universal joint couplings for driving the drum through the shaft which couplings are subject to wear and tear.

OBJECTS OF THE INVENTION

In view of the above, it is the aim of the invention to accomplish the following objects singly or in combination:

to avoid the drawbacks of the prior art as outlined above, more specifically, to assure a reliable drive of a drying drum over long periods of time;

to construct a drying drum in such a manner that means for compensating a non-circular drum rotation or means for compensating a non-circular rotation of the shaft are avoided altogether;

to avoid an impulse or shock type intermeshing between the driving elements;

to assure a substantially uniform driving torgue or moment; and to assure that an optimal intermeshing between the drive means is substantially maintained at all times.

SUMMARY OF THE INVENTION

According to the invention there is provided a drying drum, the jacket of which is supported by roller bearings at least at two locations along the length of the drum jacket, wherein the jacket itself is connected at one end thereof to a drive shaft which extends coaxially relative to the rotational axis of the drying drum, wherein driving means are guided either directly on the drive shaft or on guideways forming part of a spur gear secured to the drive shaft, and wherein the drive means are connected to an abutment means by means of a guide rod for taking up the drive or bearing reactions.

Guiding the drive means either directly on the drive shaft or on the spur gear secured to the drive shaft has the advantage that the driving element is able to follow all movement of the drive shaft or of the spur gear secured to the drive shaft, whereby an optimal intermeshing between the driving pinion and the driven spur gear is maintained independently of any radial and/or axial movements of the drive shaft. The guide rod for the drive means does not impede these movements of the drive means because the guide rod is pivoted to the drive means as well as the rigid abutment means. Simultaneously, the taking up or the transmittal of the drive reaction from the drive means to the rigid abutment means is not impaired by the pivoting connection or coupling of the guide rod.

Several different constructions of the drive means are possible for implementing the teachings according to the invention depending upon the specific size of any particular drying drum. Thus, according to one embodiment the drive means may comprise a so-called attachment or shaft mounted gear drive which is known as such. According to another embodiment, the drive shaft is driven through a spur gear secured to the drive shaft which in turn is driven by a gear drive including a pinion carriage which is guided along bearing or rollerways of said spur gear.

It is especially advantageous to construct said guide rod so that it is elastically expandable and/or that it can act as a shock absorber. This feature according to the invention compensates the irregularities in the drum movements which may occur during the drum rotation due to the materials which flow within the rotating drum jacket. Heretofore, such irregular movements have subjected the intermeshing teeth flanks to shock type loads which in turn resulted in more or less hard loads for the entire driving mechanism. The elastically expandable guide rod which may, if desired, be constructed as a shock absorber has a dampening and smoothing effect so that the driving torque is maintained substantially constant.

According to the embodiment in which the drive shaft is driven by means of a spur gear secured to the drive shaft and cooperating with a gear drive comprising pinion carriage means, it is possible to employ a plurality of such pinion carriages which are distributed about the circumference of the spur gear.

BRIEF FIGURE DESCRIPTION

In order that the invention may be clearly understood, it will now be described, by way of example, with reference to the accompanying drawings, wherein.

DETAILED DESCRIPTION OF EXAMPLE EMBODIMENTS

Figure 1:
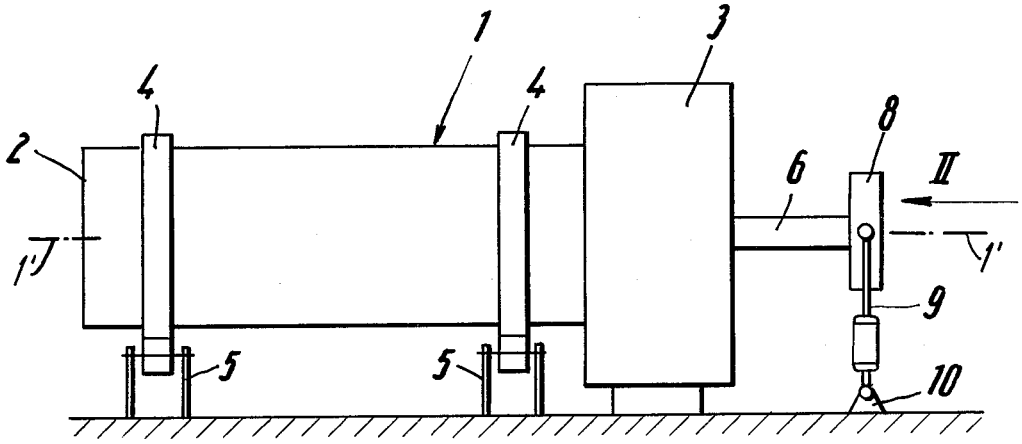
FIG. 1 illustrates in a somewhat schematic manner a drying drum constructed according to the invention.

The drying drum 1 shown in FIG. 1 is suitable for drying fluid materials that is flowable materials such as sugar. Such drums are also used in the sugar industry for the drying of leached and squeezed sugar beet cossettes. In addition to drying sugar with these drums, they may also or in the alternative be used for the cooling of the sugar.

The drying drum 1 comprises a substantially horizontally arranged drum jacket which in the shown example has the shape of a cylinder. Along the length of the drum jacket 2 there are arranged two bearing surfaces 4 which are spaced from each other. These bearing surfaces 4 are supported and guided by means of bearing rollers 5.

The flowable materials to be treated are supplied or fed into the drying drum 1 at one end of the drum jacket 2. Generally, the heating gas is also introduced at the same end. The heating gas may be produced by a burner not shown in FIG. 1. The drying drum is rotated about the rotational axis corresponding to the longitudinal cylinder axis 1'0 of the drum jacket 2, whereby the materials introduced into the drum jacket travel in the axial direction of the drum so that the materials are continuously brought into intimate contact with the heating gas. At the other end of the drum jacket 2, for example, at the end 3 in FIG. 1, outlet means are provided for removing the dried goods from the drum. The details of the feed-in means and the conveying of the dried materials as well as the details of the supply and removal of the heating gas or in the case of cooling of the cooling gases are not essential for achieving the above outlined objects.

Figure 2:
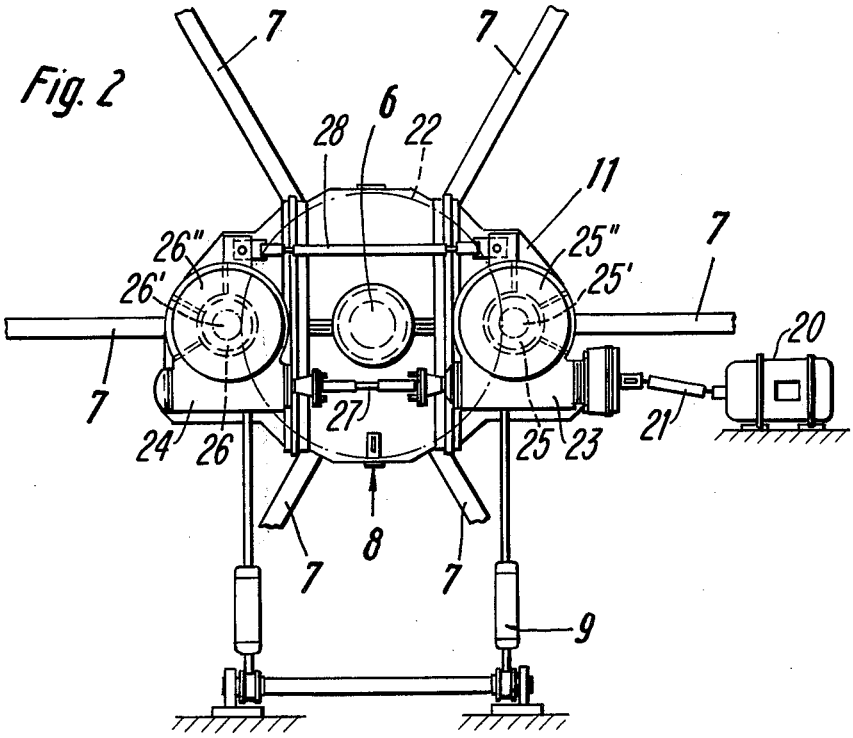
FIG. 2 shows a front view of a portion of one embodiment of a drive means for the present drying drum as viewed in the direction of the arrow II in FIG. 1.
Figure 3:
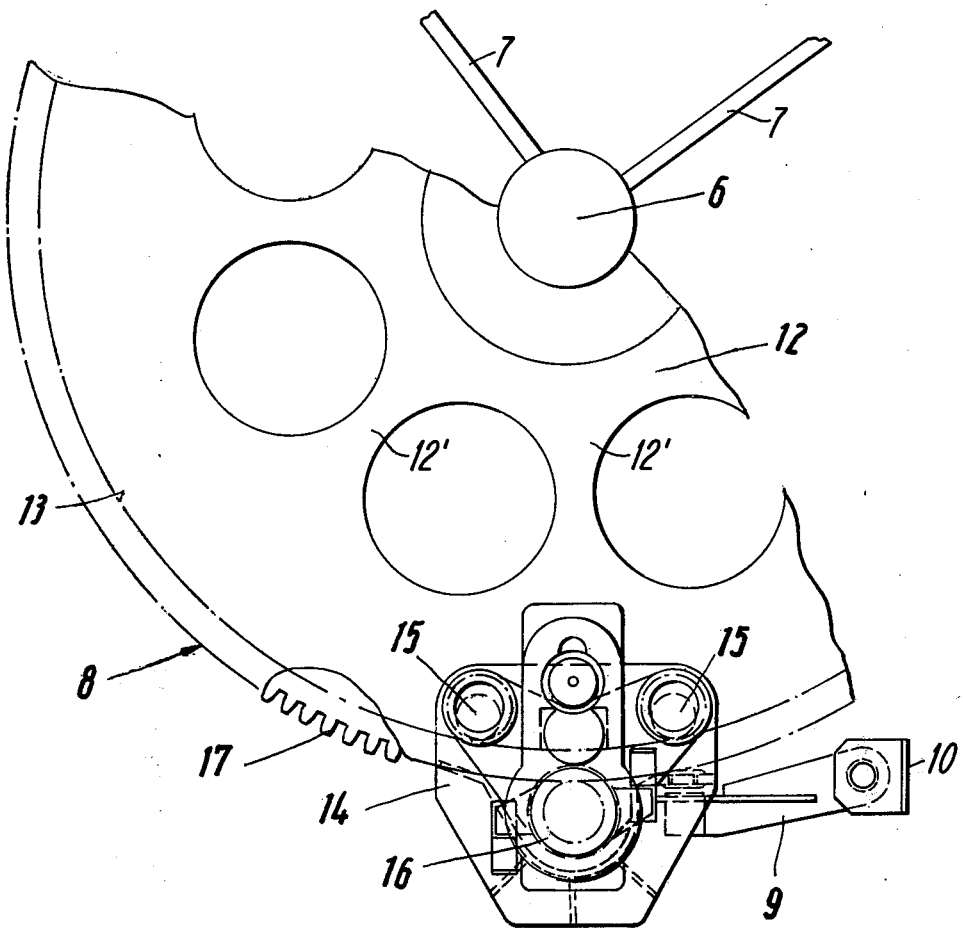
FIG. 3 shows a partial view similar to that of FIG. 2 but illustrating an alternative embodiment of the drive means.

A drive shaft 6 is connected according to the invention to one end, for example, the end 3 of the drum jacket 2. The connection between the drive shaft 6 and the drum jacket 2 may comprise, for example, the radially extending arms 7 as indicated in FIG. 2. A drive means 8 which comprises the drive gear 11 of FIG. 2 or the pinion carriage 14 of FIG. 3 is mounted on the drive shaft 6 and guided in such a manner that the drive means may follow all non-rotational movements of the shaft 6. The drive means 8 is coupled or linked to a rigid abutment means 10 by means of a linking rod 9 which takes up the bearing or drive reactions whereby the drive means 8 can move with the drum 1 but cannot rotate with the drum 1. The linking rod 9 is suitably constructed as an elastically expandable member, for example, in the form of a shock absorber so that load shocks may be compensated.

As illustrated in FIG. 2, in this example embodiment the drive means 8 comprise a so called shaft mounted gear drive 11 which in itself is known. The gear drive 11 may be driven from a fixedly mounted motor 20 by way of a flexible shaft 21 of conventional construction.

The shaft mounted gear drive 11 of FIG. 2 includes a first gear 22 operatively secured to the drive shaft 6, and two second gear means 23, 24 for example, worm gear means including worm wheels 25, 26 journaled on axles 25', 26' held in respective housings 25'' and 26''. The driving power from the motor 20 is transmitted through a flexible shaft 21 to the worm gear 23 and through a further shaft 27 interconnecting the worm gears 23 and 24. The worm wheels 25 and 26 mesh with the first gear 22. A guide rod 28 interconnects the housings 25'' and 26'', whereby the worm wheels 25, 26 driven by the worm gears 23, 24 in the housings 25'', 26'' are maintained continuously in a defined position relative to the first gear 22 and thus in meshing contact with the first gear 22. The linking rods 9 prevent the housings 25'' and 26'' from rotating around the shaft 6 but permit these housings to follow any rotation movement of the drum 1.

FIG. 3 illustrates another embodiment of the drive means 8. In this embodiment a spur gear 12 is secured to the drive shaft 6, for example, by radially extending spokes 12'. The spur gear 12 comprises at least one bearing or guide surface 13 for a pinion carriage 14. Pinion carriages as such are also known. The pinion carriage 14 comprises guide rollers 15 which continuously maintain a drive pinion 16 in a defined position relative to the gear teeth 17 of the spur gear 12 whereby the pinion 16 and the gear teeth 17 will mesh with each other. Normally, the pinion carriage 14 comprises a suitable gear drive and also carries a drive motor which is not shown in the figures. The drive shaft 6 is connected to drum 1 in FIG. 3 in the same manner as in FIG. 2.

The pinion carriage 14 is coupled to the rigid abutment means 10 through the linking rod 9. In the embodiment of the drive means 8 as shown in FIG. 3, the spur gear 12 provides the possibility to employ a plurality of pinion carriages 14 which are distributed about the circumference of the spur gear 12. By this feature, it is possible to dimension each individual driving unit or rather each indivudual pinion carriage 14 somewhat smaller than would normally be necessary if only one pinion carriage is used. Where several pinion carriages are used, the load of the teeth flanks is distributed over the individual pinions and the gear teeth 17 of the spur gear 12 which mesh with the respective pinion. This has the advantage that high flank pressures are reliably avoided.

Although the invention has been described with reference to specific example embodiments, it is to be understood, that it is intended to cover all modifications and equivalents within the scope of the appended claims.

What is claimed is:

1. A drying drum comprising a drum jacket having a rotational axis, roller bearing means for substantially horizontally supporting said drum jacket for location at at least two positions along its length, a drive shaft extending coaxially with the rotational axis of said drying drum, means for securing said drum jacket to said drive shaft, gear drive means coupled to said shaft and mounted to follow non-rotational movements of said shaft whereby said drum and drive means form an integral operational unit, a fixed abutment means, elastically expandable linking rod means connected between said abutment means and said gear drive means for inhibiting rotation of said gear drive means with said shaft while enabling said gear drive means to follow other movements of said shaft, and fixedly mounted motor means and flexible shaft means coupling said motor means to said gear drive means.

2. The drying drum of claim 1, wherein said gear drive means comprises an attachment gear drive mounted on said drive shaft.

3. A drying drum, especially for fluid materials, comprising a drum jacket having a rotation axis, bearing means for substantially horizontally supporting said drum jacket at least at two spaced positions along its length, drive means for rotating said drum jacket about said rotational axis, a drive shaft extending coaxially with said rotational axis, radially extending means securing said drum jacket to said drive shaft, said drive means including first gear means operatively secured to said drive shaft, second gear means and support means for journalling said second gear means which mesh with said first gear means, and guide means arranged for cooperation with said first and second gear means to continuously maintain said first and second gear means in a defined position relative to each other, link means and fixed abutment means, said link means connecting said support means to said fixed abutment means wherein said drum and drive means form an integral operational unit in which rotation of said second gear means about said rotational axis of said drum jacket is prevented and wherein the drive means may follow any non-rotational movement of the drum.

4. The drying drum according to claim 3, wherein said first gear means of said drive means is mounted on said drive shaft and wherein said second gear means are supported by said first gear means in the manner of a slip-on gear drive.

5. The drying drum according to claim 3, wherein said link means comprises means for elastically expanding the link means.

6. The drying drum according to claim 3, wherein said link means comprises shock absorbing means.

7. The drying drum according to claim 3, wherein said support means comprise a housing, wherein said second gear means comprise worm gear means journaled in said housing, said worm gear means being arranged to mesh with said first gear means which support said housing and the gear means in said housing on said shaft means.

8. The drying drum according to claim 3, wherein said drive means comprise a spur gear, and means for securing said spur gear to said drive shaft, said spur gear comprising a guideway for said drive means.

9. The drying drum according to claim 3, wherein said drive means comprise a spur gear, means securing said spur gear to said drive shaft, pinion carriage means arranged to engage said spur gear, a bearing surface means as part of said spur gear and roller means arranged between said bearing surface means and said pinion carriage means for guiding said pinion carriage means along said bearing surface means of said spur gear.

* * * * *